United States Patent [19]

Boehm

[11] 4,054,703

[45] Oct. 18, 1977

[54] DRAPERY HEADING

[76] Inventor: Joseph Boehm, 400 Highway 33 West, Kelowna, British Columbia, Canada, V1X 1Y1

[21] Appl. No.: 681,965

[22] Filed: Apr. 30, 1976

[51] Int. Cl.[2] ..... B32B 7/14; A47H 23/08; B32B 3/06

[52] U.S. Cl. ..... 428/194; 156/212; 156/213; 156/216; 156/226; 156/227; 156/291; 160/330; 160/387; 428/57; 428/190; 428/347; 428/124; 428/130

[58] Field of Search ..... 428/194, 347, 124, 130, 428/190, 35, 57; 160/330, 387; 156/212, 213, 216, 223, 226, 277, 291

[56] References Cited

U.S. PATENT DOCUMENTS

| | | | |
|---|---|---|---|
| 2,372,632 | 3/1945 | Webb | 428/124 |
| 2,884,053 | 4/1959 | Truesdale | 160/330 |
| 3,084,738 | 4/1963 | Truesdale | 428/190 |
| 3,097,364 | 7/1963 | Hess | 428/347 |
| 3,455,302 | 7/1969 | Liloia | 156/291 |
| 3,956,544 | 5/1976 | Harrington | 428/36 |

*Primary Examiner*—Ellis Robinson

*Attorney, Agent, or Firm*—Beveridge, DeGrandi, Kline and Lunsford

[57] ABSTRACT

An easy and quick method of placing a stiffening heading to draperies without the use of a sewing machine and the help of pins or staples. The invention discloses the use of any drapery stiffening or heading with at least one and preferably two fine lines of adhesive or glue having a low melting point positioned on the heading parallel to the longitudinal side edge thereof. The drapery fabric or crinoline is joined to one line by heat sealing and then the stiffening is turned inside of the upper end of the fabric and the second line is heat sealed whereby the drapery stiffening is secured in a straight and accurate manner to the top of the fabric whereby the pleats can subsequently be sewn therein.

2 Claims, 5 Drawing Figures

DRAPERY HEADING

Figure 1:
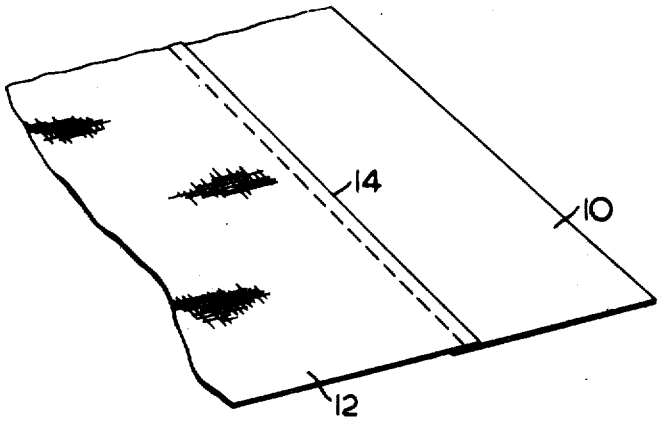

This invention relates to the manufacture of drapes and in particular the application of heading or stiffening to drapery material.

Drapery heading is used to form and give support to the pleats in draperies. Various types of drapery headings are availabe and which are now used in the drapery manufacturing art. Generally speaking, the heading or "stiffening" is made from woven or non-woven material ranging from approximately 2 and ½ to 6 inches in width and from approximately 1/64 of an inch to 1/16 of an inch in thickness. The length of this stiffener is unlimited and the degree of stiffness varies in accordance with this application.

Conventionally, the stiffening is generally sewn to the top of drapery fabrics and forms together with the drapery fabric wrapped around it, the top of a drape. Pleats are subsequently made to the material and sewn together. The use of a stiffening or heading gives the pleats the desired body. Pleats in drapes are generally sewn from approximately 2 to 6 inches apart and usually are the width of the stiffening. In order to achieve a straight heading, the stiffening must be attached to the fabric as straight as possible. This is important to achieve an even length of the overall drape as well as to provide a neat heading.

There are two known ways of sewing stiffening to fabric, (a) by the use of a straight sewing machine making a single seam or (b) by a serger which joins the stiffening and the fabric as well as overcasting the edges of both. However, sewing the stiffening to the fabric by either method and making a perfectly straight line is impossible even when attempted by an experienced operator, unless a line for the operator to follow is somehow created by pressing or marking. This is seldom done as it is very time consuming and it entails stretching the drape out first, marking a straight line, then going back to the machine for sewing. Another problem in sewing the stiffening to the fabric is that fabrics vary greatly in texture from the stiffening and joining two different fabrics by sewing often results in puckering or stretching of the fabric. Corrections constantly have to be made by trying to press a straighter line and to adjust the puckering or stretching rather frequently. In hopeless cases, the stiffening has to be removed and resewn. After this has been done, the fabric is in all cases wrapped around the stiffening at least once, mainly in order to hide the stiffening, and generally is pressed again or is held in place by staples or pins until the pleats are sewn into the heading at which point the stiffening is finally secured inside the fabric.

The object of the present invention is to overcome the deficiencies of the prior art mentioned above and to provide an easy, quick and very accurate way of placing the stiffening or heading onto a drapery fabric without the use of a sewing machine and the help of pins and staples as now practised in the art. Basically, the invention uses any drapery stiffening material whether it is woven or unwoven with two fine lines of adhesive or glue with the lowest possible melting point applied parallel to and adjacent an elongated terminal side edge of the heading material. The fabric is joined to the heading by one line and then held in place by the first and a second line of adhesive until the pleats are sewn into the top of the draperies.

According to one broad aspect, the invention relates to a drapery support heading for attachment to a drapery crinoline to provide stiffness and support thereto, comprising a flexible, planar, elongated material having a pair of fine lines of adhesive thereon positioned adjacent one longitudinal side edge of said heading material, said lines of adhesive having a low melting point whereby, when contact by heat is applied to crinoline laid on said adhesive, the latter will quickly melt and seal the heading to said crinoline.

According to a further aspect the invention relates to a method of heading a drape using a heading material having a pair of fine lines of adhesive applied parallel and adjacent to a terminal side edge of the heading, comprising the steps of (a) placing the drapery material in overlapping relation in a straight line over the edge of the heading and one adhesive line, (b) applying heat to said crinoline to melt said adhesive and seal the fabric and heading together, and (c) turning the heading material 360° within the crinoline and applying heat over the second line of adhesive to melt the same and seal the heading to and within the crinoline.

Figure 2:
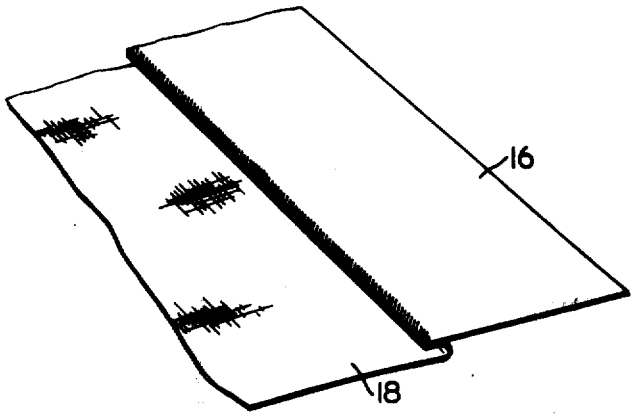
Figure 4:
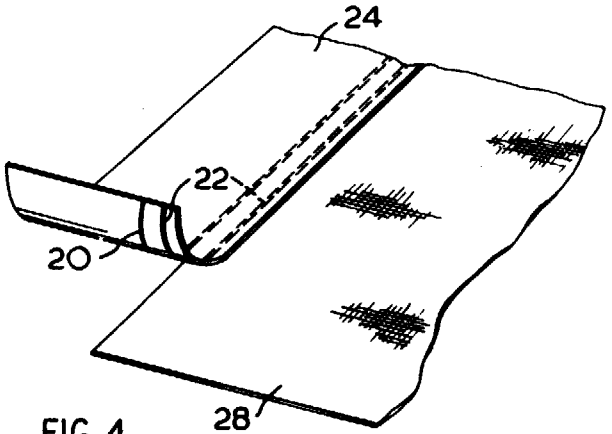
Figure 3:
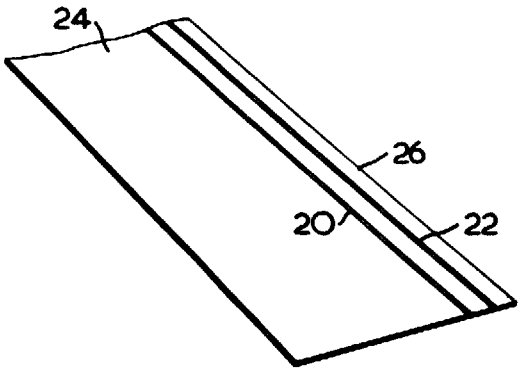
Figure 5:
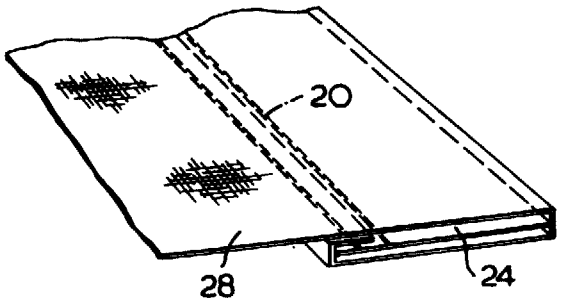

The invention is illustrated by way of example in the accompanying drawings wherein:

FIGS.1 and 2 are examples of conventional application of a drapery material to a heading, FIG. 3 is a fragmentary perspective view of a heading material according to the present invention, FIG. 4 shows a drapery material being adhesively applied to the heading in FIG. 3, and FIG. 5 shows the heading material of FIG. 4 being turned 360° inside the fabric material ready for pleating.

In the prior art example of FIG. 1, the crinoline is applied to the fabric by a sewing machine. FIG. 1 of course shows only a small part of a drapery heading 10 of non-woven material applied to the upper end of drapery material 12. The problem with sewing the heading 10 onto the fabric 12 is to sew it on straight and without stretching or puckering the fabric. To sew the fabric 12 to the fabric 10 in a perfectly straight line is almost impossible without first marking a line to follow on the heading fabric. The result, as shown, of sewing the crinoline to the heading fabric is often a crooked line 14 which has to be corrected by pressing or which will result in an uneven finished drape. It will be appreciated that it is also difficult to sew very fragile or stretchy fabrics to the heading material as the heading is usually made of very stiff material and there are very few sewing machine operators who are able to attach the two together without stretching or puckering the drapery fabric.

After the heading 10 is sewn to the fabric 12, the heading 10 is turned or flipped over 360° to be hidden within the fabric 12, and corrections of unevenness or puckering or stretching have to be made at this point. If these corrections cannot be made for example with a steam iron, or if the heading is too crooked, the crinoline has to be removed and a new one put in. After the above-mentioned folding, the fabric is held in place by either stapling or pinning which is removed after the pleats are sewn into the material. It will be appreciated that the sewing of the heading to the fabric is mainly done to keep the fabric in place until the pleats are sewn therein. There is no stress on the fabric or heading after this is done. The pleats on draperies are generally 3 to 5 inches apart and no stress whatever is placed on the joining seam of the fabric and the heading.

In the second example of the prior art, a woven heading 16 is shown which has the same function as that of non-woven headings. In this example the sewing is done by a serger and the same problems exist in this method of applying the heading 16 to the fabric 18 as existed in the method of FIG. 1. Moreover, in the method of FIG. 2 it is more difficult to make corrections as the heading is more firmly attached to the fabric and it is extremely difficult to remove the heading from the fabric once it has been sewn on.

Referring to FIGS. 3, 4 and 5, I used straight lines of adhesive on the heading to secure the heading to the fabric prior to the pleats being made. One line of adhesive can be used in combination with pins or staples after the heading has been folded into the fabric or, preferably, two lines of adhesive are used in the following manner.

An adhesive of low melting point say in the region of 140° or lower is applied in two parallel lines 20 and 22 onto the upper surface of the heading 24 and adjacent an elongated terminal side edge 26 thereof. By placing the lines of adhesive in this manner on the heading whether it is woven or non-woven, the drapery fabric 28 can be laid perfectly straight over the first adhesive line 22 as shown in FIG. 4, with little effort. The type of drapery fabric is of no consequence. The drapery fabric is laid on a table and the heading is placed on top of it in a perfectly straight line and a steam iron is used to seal the fabric and the heading together since the adhesive has a very low melting point and the line thereof is very fine, 1/16 of an inch to 1/32 of an inch is preferred. This sealing operation can be effected almost as fast as one can move the steam iron over the fabric 28 and the latter is not affected by the pressing as the iron is placed on the heading. (FIG. 4 in effect is a view of the underside of the sealing operation). Before too much heat can reach the drapery fabric, the glue is melted and has sealed the heading thereto. No stretching or puckering can occur in this method.

The second step in the operation as shown in FIG. 5 is to turn the drapery fabric 28 so that the heading 24 is covered thereby and rather than staple or pin the fabric to the heading, the latter is pressed over the second line (this view again being reversed) to activate the second glue line 20 which holds the folded fabric 28 and the heading 24 in place, thus eliminating the use and removal of pins or staples.

The present method of applying the fabric to the heading has two distinct advantages over the prior art. Firstly, a perfectly straight drapery heading can be made with little effort and which will have a great effect on the finished product in that the length of the drape can be more accurately prepared. Secondly, corrections and the use of pins and staples is eliminated and substantial time is saved.

I claim:

1. A drapery support heading for attachment to a drapery crinoline to provide stiffness and support thereto, comprising a flexible, planar, elongated material having a pair of fine lines of adhesive thereon positioned adjacent one longitudinal side of said heading material, said lines of adhesive having a low melting point to seal the heading to said crinoline when heat is applied thereto when the crinoline is laid on the adhesive.

2. A method of heading a drapery crinoline using a heading material having a pair of fine lines of adhesive applied parallel and adjacent to a terminal side edge of the heading, comprising the steps of (a) placing the drapery material in overlapping relation in a straight line over the edge of the heading and one adhesive line (b) applying heat to said crinoline to melt said adhesive and seal the fabric and heading together (c) turning the heading material 360° within the crinoline and applying heat over the second line of adhesive to melt the same and seal the heading to and within the crinoline.

* * * * *